US010937395B2

(12) United States Patent
Oberg

(10) Patent No.: US 10,937,395 B2
(45) Date of Patent: Mar. 2, 2021

(54) SADDLE FOR A STRINGED MUSICAL INSTRUMENT

(71) Applicant: Robert L. Oberg, Syosset, NY (US)

(72) Inventor: Robert L. Oberg, Syosset, NY (US)

( * ) Notice: Subject to any disclaimer, the term of this patent is extended or adjusted under 35 U.S.C. 154(b) by 0 days.

(21) Appl. No.: 16/539,714

(22) Filed: Aug. 13, 2019

(65) Prior Publication Data

US 2019/0392790 A1 Dec. 26, 2019

Related U.S. Application Data

(63) Continuation-in-part of application No. 15/852,127, filed on Dec. 22, 2017, now abandoned, which is a continuation of application No. 15/659,438, filed on Jul. 25, 2017, now Pat. No. 9,978,346.

(60) Provisional application No. 62/366,346, filed on Jul. 25, 2016.

(51) Int. Cl.

| | |
|---|---|
| ***G10D 3/04*** | (2020.01) |
| ***G10D 1/08*** | (2006.01) |
| ***G10D 3/02*** | (2006.01) |
| ***G10D 3/12*** | (2020.01) |
| ***G10H 3/18*** | (2006.01) |

(52) U.S. Cl.

CPC ..... *G10D 1/08* (2013.01); *G10D 3/02* (2013.01); *G10D 3/04* (2013.01); *G10D 3/12* (2013.01); *G10H 3/18* (2013.01)

(58) Field of Classification Search

CPC ..... G10D 3/04; G10D 3/10; G10H 3/185; G10H 2220/471; G10H 1/32; G10H 2220/495

See application file for complete search history.

(56) References Cited

U.S. PATENT DOCUMENTS

| | | | | |
|---|---|---|---|---|
| 5,750,910 | A * | 5/1998 | LoJacono | G10D 3/04 84/314 N |
| 6,031,165 | A * | 2/2000 | Brekke | G10D 3/04 84/298 |
| 6,706,957 | B1 * | 3/2004 | Merkel | G10D 3/12 84/314 N |
| 2003/0177894 | A1 * | 9/2003 | Skinn | G10H 3/185 84/730 |
| 2005/0188814 | A1 * | 9/2005 | Bell | G10D 1/00 84/298 |
| 2015/0135929 | A1 * | 5/2015 | Powers | G10D 3/12 84/298 |

(Continued)

*Primary Examiner* — Marlon T Fletcher

(74) *Attorney, Agent, or Firm* — Scarinci Hollenbeck, LLC

(57) ABSTRACT

A saddle for a stringed musical instrument comprising a body having at least one member with a first and second section. The first section, in cross section has opposite ends, and a geometry conforming to the geometry of a slot in a bridge plate and a width approximately equal in dimension to the width of the slot so the opposite ends of the first section tightly fit into the slot when the first section is inserted therein. The second section having a width substantially wider than the width of the first section and having two lateral sides, in cross section, extending from the opposite ends of the first section to form, in combination with the first section, a right-side up "T" fitting such that the saddle possesses a substantially higher resistance to bending forces from tension in the strings in the musical instrument as compared conventional saddle structures.

18 Claims, 7 Drawing Sheets

(56) References Cited

U.S. PATENT DOCUMENTS

2018/0025705 A1* 1/2018 Oberg ..... G10H 1/32
84/731

* cited by examiner

SADDLE FOR A STRINGED MUSICAL INSTRUMENT

FIELD OF THE INVENTION

The present invention is a continuation in part of U.S. patent application Ser. No. 15/852,127 filed on Dec. 22, 2017, which is a continuation of U.S. patent application Ser. No. 15/659,438 filed on Jul. 25, 2017, which is incorporated herein by reference, and relates more particularly to the construction of a saddle for a stringed musical instrument, particularly an acoustical guitar, for structurally supporting the guitar strings at a predetermined elevated position above the sound board of the musical instrument. A transducer type pickup for converting mechanical energy from the vibration of the guitar strings into an electrical signal may be used in conjunction with the saddle and if so, is preferably imbedded within the body of the saddle to form a single integrated unit which will hereinafter be referred to as a "saddle-up".

BACKGROUND OF THE INVENTION

A stringed musical instrument employs a saddle to support the strings at a desired elevated position over the sound board of the musical instrument. For a guitar or ukulele the saddle is inserted in a bridge or bridge plate mounted on the sound board of the musical instrument which, in general, corresponds to the anatomical front board of the instrument. Alternatively, as taught in corresponding US patent application Ser. No. 15/659,438, both the anatomical front board and the anatomical rear board of the acoustical guitar are used as sound boards for the musical instrument, with the rear board modified for the attachment of a saddle and bridge plate and with the guitar having a single set of strings strung over the saddle on the rear sound board through the interior body of the guitar to the front sound board over the saddle on the front bridge plate. A transducer pickup is conventionally used for converting the string's vibrations into an electrical signal for transmission to a loud speaker through one or more preamplifier's. In applicants corresponding U.S. patent application Ser. No. 15/659,438, a transducer pick up, of any conventional type, is described for use with each saddle with the transducer pick up placed within a slot in each bridge plate so that it lies contiguous to the saddle or alternatively, with the transducer pick up imbedded within the body of the saddle to form a single integrated "saddle-up" unit for each sound board. The transducer pick up imbedded within the body of the saddle is fully enclosed within the saddle and surrounded on all sides by the material used to create the saddle.

A conventional saddle for a guitar or ukulele or the like has a geometry, in cross section, which conforms to the cross sectional geometry of a slot or cavity in the bridge plate attached to the sound board of the guitar or ukulele, so that the saddle will fit tightly within the slot of the bridge plate. Accordingly, if the slot in the bridge plate is rectangular, the saddle should also have a rectangular geometry and a width which is substantially equal to the width of the slot in the bridge plate. The height of the conventional saddle must allow the saddle body to extend above the bridge plate a sufficient distance so that the guitar strings lie elevated a desired predetermined height above the sound board. This height needs to be essentially constant throughout play. However, since the body of a conventional saddle will, in general, bend in response to the tuning of the guitar strings the elevation and angle of the guitar strings requires continual readjustment during play to reestablish a desired string elevation, and maintain accurate intonation of a stringed instrument.

It has been discovered in accordance with the present invention that by reconfiguring the geometrical body of the saddle, when composed of one member, to comprise at least two sections including a first section with a geometry conforming to the geometry of the slot in the bridge plate mounted on the sound board of the musical instrument and having a width in close approximation to the width of the slot in the bridge plate and a second section having sides extending from the first section such that the width of the second section is substantially wider than the width of the first section and with the first and second sections forming, in combination, a "T" fitting, in cross section, the saddle will possess substantially increased strength and resistance to bending, when tuning the strings in the musical instrument, substantially greater than that of a conventional saddle. In addition, by incorporating a transducer pickup within the body of the saddle, a single integrated "saddle-up" is formed which will support the strings of the musical instrument at a constant predetermined elevation above the sound board in the musical instrument independent of the tension in the strings and will simultaneously convert mechanical energy from string vibrations into an electrical signal for transmission to an amplifier or pre-amplifier.

SUMMARY OF THE INVENTION

A saddle for a stringed musical instrument, such as a guitar or ukulele, having at least one bridge or bridge plate, attached to a sound board corresponding to an anatomical surface of the musical instrument with the bridge or bridge plate having a slot within which the saddle is adapted to be inserted, said saddle comprising a body having at least one member with a first and second section in which the first section has a geometry conforming to the geometry of the slot in the bridge and a width having opposite ends approximating the width of the slot in the bridge so that the opposite ends of the first section tightly fit into the slot of the bridge when the first section is inserted therein and with the second section having a width substantially wider than the width of the first section and having two lateral sides which, in cross section, extend outwardly from the opposite ends of the first section to form, in combination with the first section, a "T" fitting whereby the saddle possesses a substantially high resistance to bending forces resulting from tuning the strings in the musical instrument. The two lateral sides of the second section extend outwardly a distance of at least about 1/16th of an inch and optimally at least an $1/8^{th}$ of an inch from each opposite side of the first section. This right-side up "T" fitting has full contact with the sound board surface. Specifically, the bottom surface of the "T" fitting sits flush with the top of the bridge plate.

When the saddle body comprises only one member having a first and second section, the second section of said one member should support the strings of the musical instrument at a predetermined elevation above the sound board of the musical instrument and should possess a cross sectional shape selected from the group consisting of a triangular geometry, a curvilinear geometry including a semi-circle, a sector of a circle, or a rectangular geometry. The second section of the saddle body, having only one member, may include a plurality of notches with one notch for each string to allow for accurate height adjustment of the strings above the bridge plate and for reducing string adjustment when tuning. The plurality of notches are separated a predetermined distance apart from one another along the length of the second section in a direction parallel to the slot in the bridge into which the first section of the saddle body is inserted.

In an alternative embodiment of the invention, the saddle body comprises at least two members with at least a first member having a first and second section in which the first section has a geometry conforming to the geometry of the slot in the bridge and a width with opposite ends with the distance between said opposite ends being approximately equal in dimension to the width of the slot in the bridge so that the opposite ends of the first section tightly fit into the slot of the bridge when the first section is inserted therein and with the second section having lateral sides extending from the first section and having a width, in cross section, substantially wider than the width of the first section to form, in combination with the first section, a "T" fitting, which increases the saddle resistance to bending forces relative to the bending resistance of conventional saddle structures upon tuning the strings. The first and second members of the saddle body in this embodiment of the invention preferably includes means for removably interconnecting and disconnecting the first member from the second member such that upon disconnecting the two members the height of the first member may be manually adjusted for controlling the adjustment of the overall height of the saddle and wherein the second member may include a plurality of notches equal in number to the number of strings with each notch separated a predetermined distance apart from one another along the length of the second section in a direction parallel to the slot in the bridge into which the first member of the saddle is inserted.

The saddle of the present invention may be used in conjunction with a conventional type transducer pickup in which instance the transducer pickup may be inserted into the slot of the bridge plate so that the transducer pick up lies contiguous to the saddle or the saddle and transducer pick up may be combined into a single "saddle-up" unit with the transducer pick up internally imbedded within the body of the saddle to be used for simultaneously supporting the guitar strings above the sound board and for converting mechanical energy from the guitar string vibrations into an electrical signal for transmission to an amplifier or pre-amplifier. The imbedded transducer pick up is fully enclosed on all sides by the material used to create the saddle. The saddle is a one-piece, fully enclosed device. The saddle may also include a dual "saddle-up" configuration in which a transducer pick up is internally imbedded within both a lower and an upper section of the body of the saddle so that each transducer pick up may be connected to a separate pre-amplifier.

BRIEF DESCRIPTION OF THE DRAWINGS

Other advantages of the subject invention will become apparent from the following detailed description of the invention when read in conjunction with the accompanying drawings of which.

DETAILED DESCRIPTION OF THE INVENTION

All of the following drawings teach alternate preferred embodiments of the saddle of the present invention without limiting the scope of the invention.

Figure 1:
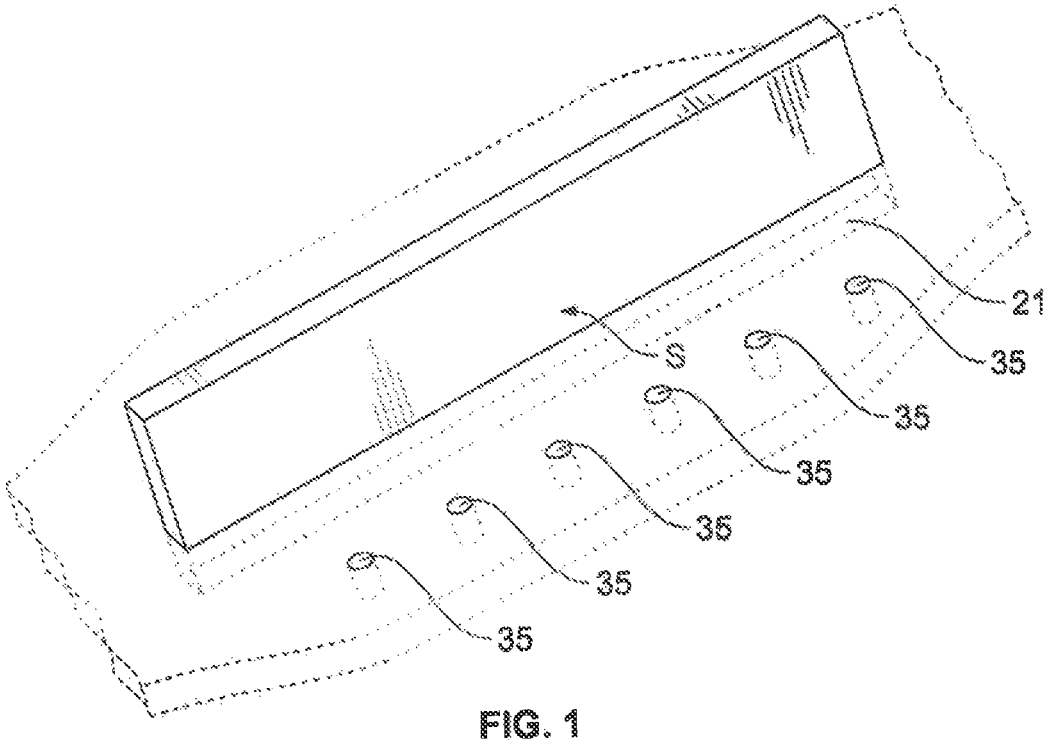
FIG. 1 is a perspective view of a conventional saddle shown supported within a conventional bridge plate, illustrated using dotted lines, which is adapted for attachment to the sound board of a stringed musical instrument (not shown)

A conventional saddle S is illustrated in perspective in FIG. 1 having a cross sectional geometrical shape which conforms to the geometry of the slot 21 in a conventional bridge plate, illustrated using dotted lines, which is adapted for attachment to the sound board of a stringed musical instrument (not shown). Both the saddle S and slot 21 are typically rectangular in geometry. A plurality of holes 35 are shown in the bridge plate for the strings of the musical instrument to pass through.

Figure 2:
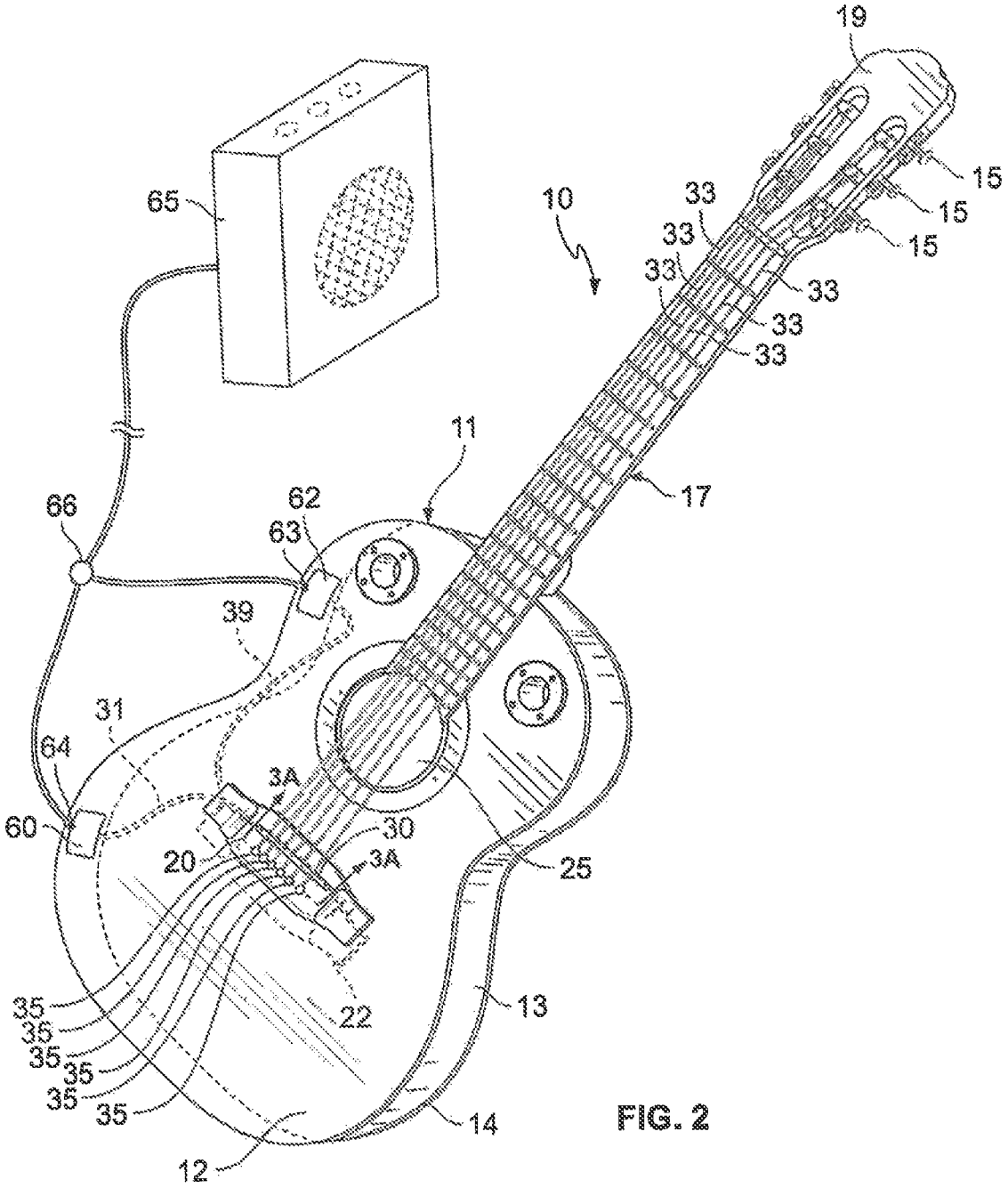
FIG. 2 is an anatomical perspective view of an acoustical guitar having a saddle and bridge plate located on both the front and rear sound boards of the guitar with each saddle having a separate transducer pick-up.

A first embodiment of the saddle of the present invention is shown in FIG. 2 having a body 30 mounted in a bridge plate 20 on the anatomical front sound board 12 of an acoustical guitar 10. The acoustical guitar 10, as is shown in FIG. 2, corresponds to the acoustical guitar 10 described in applicants corresponding patent application Ser. No. 15/659,438 which comprises a hollow body 11 having an anatomical front sound board 12, a anatomical rear sound board 14, a first bridge plate 20 mounted on the front sound board 12 and a second bridge plate 22 mounted on the rear sound board 14. The bridge plate 22 mounted on the rear sound board 14 is illustrated in FIG. 2 using dotted lines. Another saddle (not shown) is also mounted on the rear bridge plate 22 of the guitar 10. This saddle may also have a body geometrically identical to the saddle body 30 mounted in the anatomical front sound board 12 or may have a body with a geometry different from the geometry of the saddle body 30 and may be selected from one of the alternative embodiments of the saddle of the present invention described hereafter in connection with FIGS. 5-9 inclusive.

The guitar 10, shown in FIG. 2, has sides 13 which interconnect the front sound board 12 to the rear sound board 14 to fully enclose the hollow body of the guitar 10. A single set of strings 33, of custom length, extends from the tuning knobs 15 in the headstock 19 at the top end of the guitar 10, along the neck 17 of the guitar 10 over the saddle 30 in the first bridge 20 from whence they pass through the string openings 35 on the first bridge plate 20 through the hollow interior body 11 of the guitar 10 to the bridge plate 22 on the rear sound board 14 to which the guitar strings 33 are pegged as explained in greater detail in applicants corresponding patent application Ser. No. 15/659,438. The saddle mounted in each bridge plate 20 and 22 supports the set of strings 33 at the same elevation or at different predetermined elevations over each bridge plate 20 and 22 respectively. Unlike prior art saddles, the saddle of the present invention corrects elevation of guitar strings and maintains correct intonation.

Figure 3:
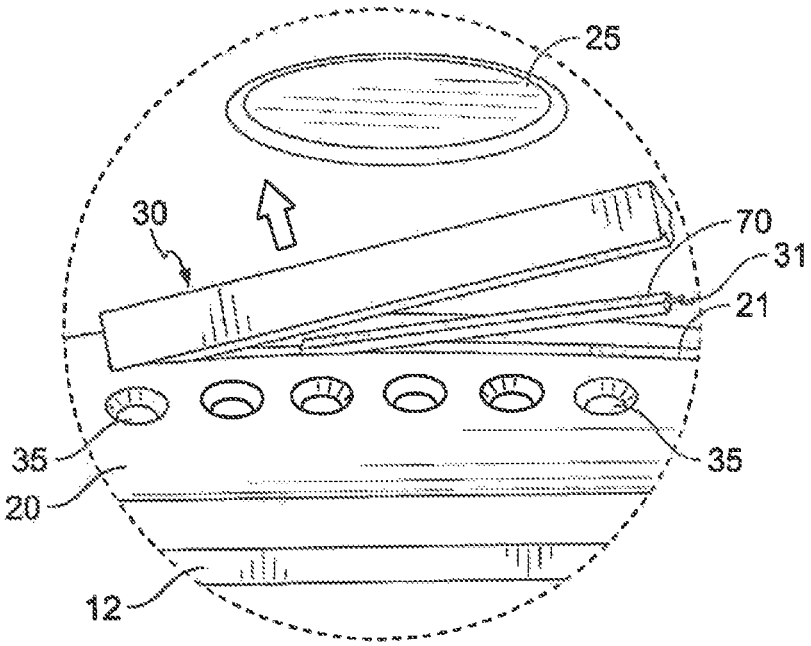
FIG. 3 is a visual perspective view of a preferred embodiment of the saddle of the present invention shown partially withdrawn from the slot in the bridge plate on the front sound board of the guitar in FIG. 2 taken along the lines 3A-3A of FIG. 2 for use with a conventional transduce pick up placed in the slot in the bridge plate underneath the saddle.
Figure 4:
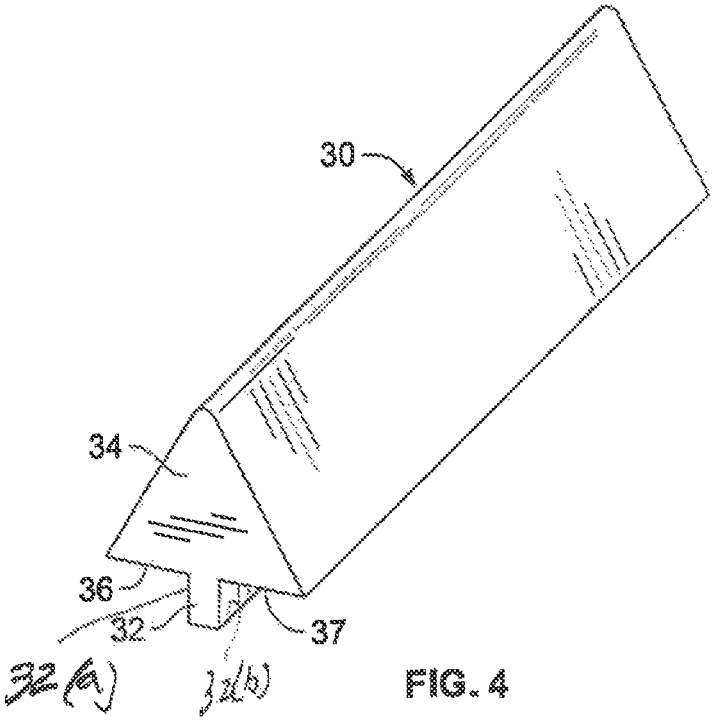
FIG. 4 is a perspective view of the embodiment of the saddle of the present invention shown in FIG. 3 with the body of the saddle having a first section of rectangular geometry and a second section having a pyramid configuration extending from the first section with the geometry of the second section being triangular in cross section and having two lateral sides extending from the ends of the rectangular first section such that the width of the second section is substantially larger than the width of the first section.
Figure 4A:
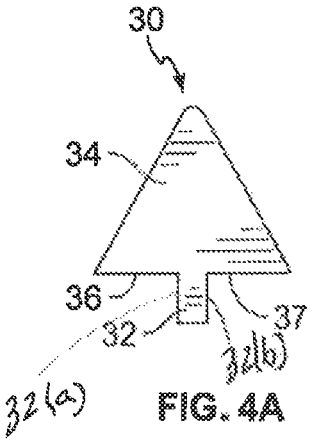
FIG. 4A is an end view of FIG. 4 showing the cross sectional geometry of the first and second sections which, in combination, form a conventional "T" fitting for insertion of the saddle into the slot in the bridge plate of the guitar.

FIG. 3 is a visual illustration of a preferred embodiment of the saddle of the present invention with its body 30 having a geometrical shape as shown in FIGS. 4 and 4A with the body 30 being partially withdrawn from the slot 21 in the bridge plate 20 and with a conventional transducer pick up 70 shown mounted within the slot 21 of the bridge plate 20 beneath the saddle body 30 so that the saddle body 30 is seated within the slot 21 above the transducer pick up 70.

As shown in FIGS. 3, 4 and 4A the saddle body 30, which represents the first embodiment of the saddle of the present invention, comprises a first section 32 having a rectangular geometry which conforms to the rectangular geometry of slot 21 in the bridge plate 20 and a second section 34 of triangular geometry which extends from the first section 32. The first section 32 has two opposite ends 32(*a*) and 32(*b*) with a width dimension substantially identical to the width of slot 21 so that the first section 32 will fit tightly into slot 21 when inserted therein as shown in FIG. 3. In use, the first section 32 will slide into the slot 21 and will fit snug therein without moving. Specifically, the opposite ends 32(*a*) and 32(*b*) are flush with the walls of the slot 21. Thus, in use, the first section 32 becomes buried entirely within the slot 21 cavity.

The second section 34 extends from the first section and preferably includes two sides 36 and 37 which laterally extend from the two ends 32(*a*) and 32(*b*) of the first section 32 so that the first and second section, in combination, form a "T" fitting, with the width of the second section 34 being substantially greater than the width of the first section 32. This results in the saddle body 30 possessing substantial bending resistance against bending forces in response to the tuning of the guitar strings. The lateral sides 36 and 37 are preferably equal in dimension with each side preferably being at least 1/16th of an inch wider than the width of the first section 32 and optimally at least 1/8th of an inch wider than the width of the first section 32. The second section 34 may however extend from only one side of the first section 32 to form an "L" configuration or each lateral side 36 and 37 may be of substantially different length. The bottom surface of the two sides 36 and 37 of the saddle body 30 sits flush with the top surface of the bridge plate that is on the guitar body. The "T" fitting thus is in full, direct contact and full attachment with the sound board surface or the bridge plate. By fully attaching the sides 36 and 37 to the surface of the bridge plate we are able to improve sound quality as the "T" fitting eliminates bending and increases and improves sonic performance.

Figure 5:
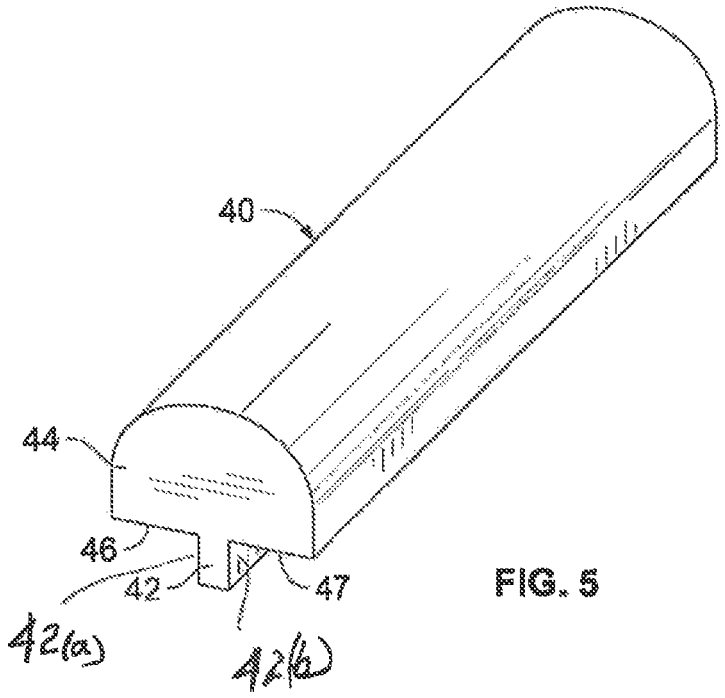
FIG. 5 is a perspective view of a second embodiment of the saddle of the present invention having a body with a first section of rectangular geometry for insertion into the slot of the guitar and a second section extending from the first section having a barrel shaped configuration, with a cross sectional semi-circular geometry, having two lateral sides extending, in cross section, from the ends of the rectangular first section such that the width of the second section is substantially larger than the width of the first section to form a "T" fitting in cross section.

The second embodiment of the saddle of the present invention has a body 40 forming a barrel shaped single member configuration as shown in FIG. 5 comprising at least a first section 42 having a rectangular geometry which may conform to the rectangular geometry in the first section 32 of the first embodiment of the saddle shown in FIG. 4 and a second section 44 having a substantially semi-circular geometry extending from the first section 42. The second section 45 has two lateral sides 46 and 47 extending from the opposite ends 42(*a*) and 42(*b*) of the first section 42 so that the first and second section, in combination, form a "T" fitting, in cross section with the width of the second section 44 being substantially greater than the width of the first section 42. The lateral sides 46 and 47 should preferably be substantially equal in dimension with each side preferably being at least 1/16th of an inch wider than the width of the first section 42 and optimally at least 1/8th of an inch wider than the width of the first section 42. However, as in the first embodiment, each side may be of different length or the second section 45 may extend outwardly from only one of the opposite ends of the first section. The bottom surface of the lateral sides 46 and 47 of the body 40 sits flush with the top of the bridge plate thus being in full, direct contact and full attachment with the sound board surface or the bridge plate.

Figure 6:
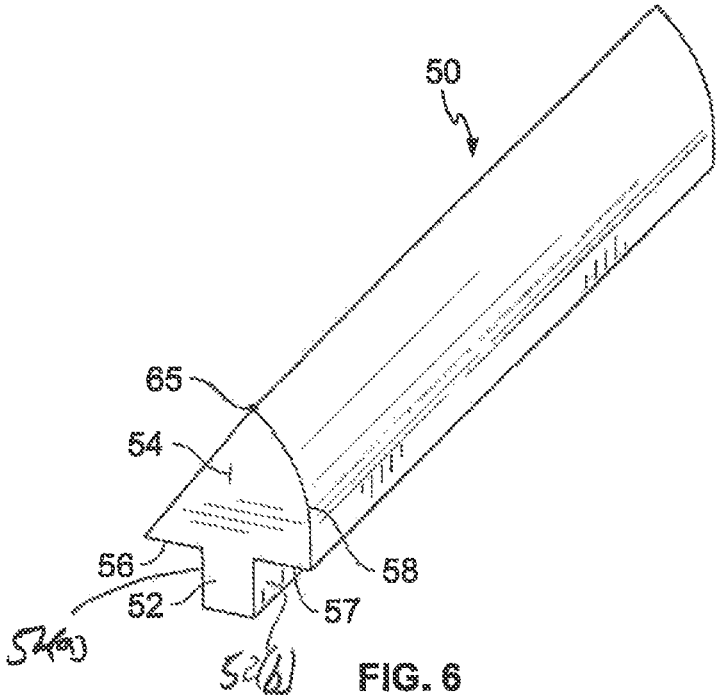
FIG. 6 is a perspective view of a third embodiment of the saddle of the present invention having a body with a first section of rectangular geometry for insertion into the slot of the guitar and a second section extending from the first section having a curvilinear configuration which corresponds to a segment of a circle and having two lateral sides extending, in cross section, from the ends of the rectangular first section such that the width of the second section is substantially larger than the width of the first section to form a "T" fitting in cross section.

The third embodiment of the saddle of the present invention has a body 50 forming a single member configuration as shown in FIG. 6 comprising a first section 52 having a rectangular geometry which may conform to the rectangular geometry of the first sections 32 and 42 in the first and second embodiments shown in FIGS. 4 and 5 for engaging the rectangular slot 21 in the bridge plate 20 and a second section 54 extending from the first section 52 having a curvilinear segment 58 corresponding to a predetermined sector of a circle. The second section 54 has two lateral sides 56 and 57 which extend from the opposite ends 52(*a*) and 52(*b*) of the first section 52 so that the first and second section, in combination, form a "T" fitting, in cross section, with the width of the second section 54 being substantially greater, in cross section, The two lateral sides 56 and 57 are preferably equal in dimension with each side preferably being at least 1/16th of an inch wider than the width of the first section 52 and optimally at least 1/8th of an inch wider than the width of the first section 52. However, as in the first embodiment, each of the two lateral sides may have a different length or the second section 54 may extend laterally from only one of the opposite ends of the first section. Similar to the other embodiments, the bottom surface of the lateral sides 56 and 57 of the body 50 sits flush with the top of the bridge plate thus being in full, direct contact and full attachment with the sound board surface or the bridge plate.

Figure 7:
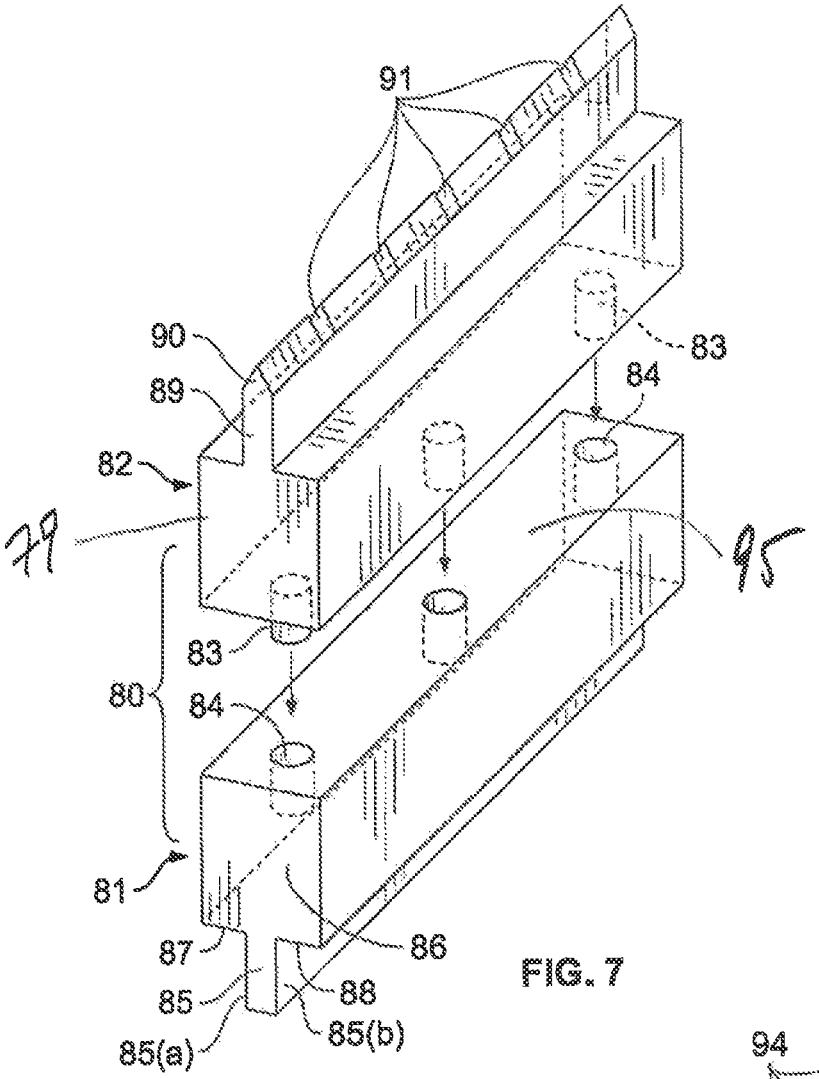
FIG. 7 is an exploded view in perspective of a fourth embodiment of the saddle of the present invention comprising a body having first and second dual members arranged in tandem with the first member adapted for insertion into the slot in the bridge mounted on the sound board of the musical instrument and the second member adapted for supporting the strings of the musical instrument a predetermined distance above the sound board with the first member comprising a first and second section with the first section having a geometry conforming in cross section to the geometry of the slot in the bridge and with the second section extending from the first member and having, in cross section, two lateral sides extending from the ends of the first section such that the width of the second section is substantially wider than the width of the first section for forming a "T" fitting in cross section, and with the first and second members being removably interconnected to one another with the second member having a first section of rectangular geometry and a second section extending from the first section for supporting the strings of the musical instrument a predetermined distance above the first section with the second section having a contoured upper end with a triangular cross sectional geometry and having a plurality of notches equal to the number of strings in the guitar and being spaced a predetermined distance apart along the length of the second member in a direction parallel to the slot in the bridge.

The fourth embodiment of the saddle of the present invention is shown in FIG. 7 with the saddle having a body 80 including a lower and upper dual member 81 and 82 respectively, arranged in tandem, with the lower member 81 comprising a first section 85 in a rectangular geometry having opposite ends 85(*a*) and 85(*b*) adapted to fit tightly into the slot 21 of the bridge plate 20 on the front sound board 12 of the guitar 10. and a second section 86 extending from the first section 85. The second section 86 has two sides 87 and 88 which extend laterally from the opposite sides 85(*a*) and 85(*b*) of the first section 85 such that the first and second section, in combination, form a "T" fitting, in cross section, with the width of the second section 86 being substantially greater than the width of the first section 85. The two lateral sides 87 and 88 in the second section 86 are preferably equal in dimension with each side preferably being at least 1/16th of an inch wider than the width of the first section 85 and optimally at least 1/8th of an inch wider than the width of the first section 85. However, as in the first embodiment, each of the two lateral sides 87 and 88 may have a different length or the second section 86 may extend laterally from only one of the opposite sides 85(*a*) and 85(*b*) of the first section. Like the other embodiments, the bottom surface of the lateral sides 87 and 88 of the body 80 sits flush with the top of the bridge plate thus being in full, direct contact and full attachment with the sound board surface or the bridge plate.

The lower and upper dual members 81 and 82 are removably interconnected into one another by means of the upper member 82 having male dowels or projections 83 which extend from the upper dual member 82 and are adapted to fit within corresponding female openings 84 in the lower dual member 81 such that the upper member may be manually interconnected and disconnected or separated from the lower member 81. This allows for accurate height adjustment of the saddle in that the upon disconnecting the upper member 82 from the lower member 81, the surface 95 of the lower member 81 may be sanded down to reduce its original height thereby accurately controlling the height that the saddle extends from the bridge plate in which it is inserted which corresponds to the elevation of the guitar strings above the sound board. This advantage allows the user to personalize the string elevation eliminating string buzz and providing a universal fit for all guitar brands. Furthermore, unlike prior art saddles, the saddle of the present invention corrects elevation of guitar strings and maintains correct intonation.

The upper member 82 of the dual member saddle 80 may comprise a rectangular first section 79 and a second section 89 which extends from the rectangular lower section 79. The second section 89 may have an upper surface 90 with a triangular cross sectional geometry corresponding to the triangular cross sectional geometry of the saddle member 34 in the first embodiment as shown in FIG. 4 for engaging the strings in the guitar 10 or may instead may have a geometry similar to either the barrel shaped cross sectional geometry of member 44 in the second embodiment shown in FIG. 5 or the curvilinear geometry of the third embodiment shown in FIG. 6.

The dual member saddle embodiment shown in FIG. 7 further includes a plurality of spaced apart notches 91, equal in number to the number of guitar strings, with the plurality of notches extending lengthwise in section 89 in a direction parallel to the direction of the slot 21 in the bridge plate 20. The notches 91 should have a geometry, in cross section, which corresponds to the cross sectional geometry of the upper surface 90.

Although the single member saddle embodiments shown in FIGS. 3-6 do not include notches in the upper section of the saddle body it is understood that notches of any desired geometry may be included if desired. Moreover, a notchless saddle body as shown in the single member saddle embodiments corresponding to FIGS. 3-6 inclusive may offer an advantage over a saddle configuration which includes notches in that an advanced user or professional Luthier using a notchless saddle body is readily able to modify string guides to specific string dimensions which allows for custom modifying of the overall height adjustment of the saddle.

Figure 7A:
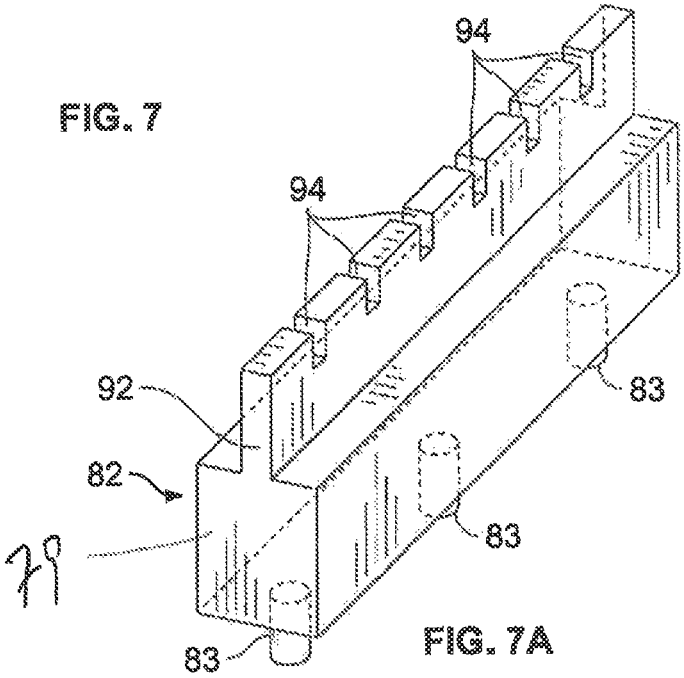
FIG. 7A is a variation in perspective of the second dual member of the embodiment of the saddle shown in FIG. 7 comprising a first section of rectangular geometry and a rectangular second section extending from the first section with the rectangular second section having a plurality of spaced apart notches, each rectangular in cross sectional geometry, extending along the length of the saddle parallel to the slot in the bridge plate for engaging the guitar strings.

A variation in the configuration of the upper dual member 82 in the dual member saddle configuration 80 shown in FIG. 7 is shown in perspective in FIG. 7A with the upper dual member 82 including an upper section 92 of rectangular geometry extending from the lower section 79 with the upper section 92 having a plurality of spaced apart notches 94 of rectangular geometry which equal in number to the number of guitar strings and extend lengthwise in section 92 in a direction parallel to the direction of the slot 21 in the bridge plate 20. The "box" notches 94 of rectangular geometry provide substantial advantages over the standard "V" notches in a conventional saddle.

Figure 8:
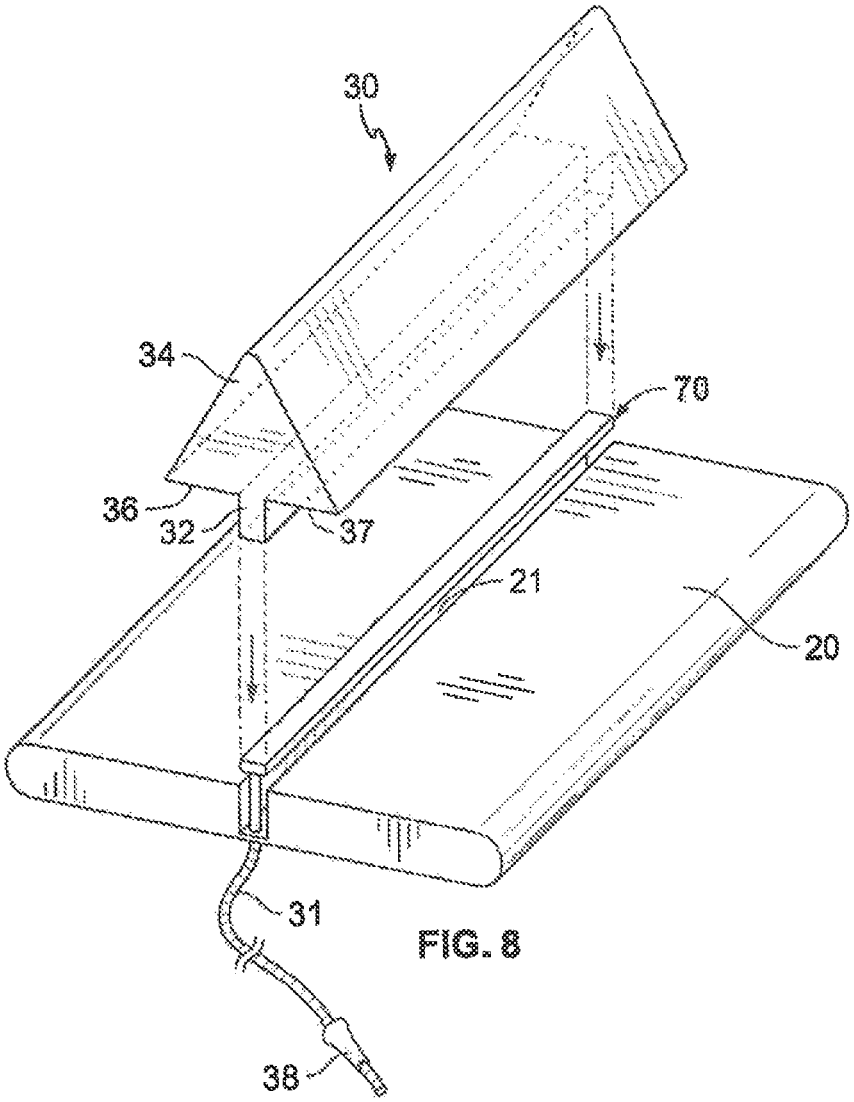
FIG. 8 is an exploded perspective view of the saddle of the present invention with the body of the saddle having a first and second section conforming to the geometry of the first and second section of the saddle embodiment shown in FIGS. 3 and 4 with the first section being rectangular in geometry and in alignment with the rectangular slot 21 of the bridge plate of the guitar shown in FIG. 2 into which it is inserted and with the second section having two lateral sides which extend, in cross section, from the ends of the first section for forming a "T" fitting with the width of the second section being substantially greater than the width of the first section and showing a conventional transducer pick up aligned with the slot in the bridge plate underneath the first section.
Figure 9:
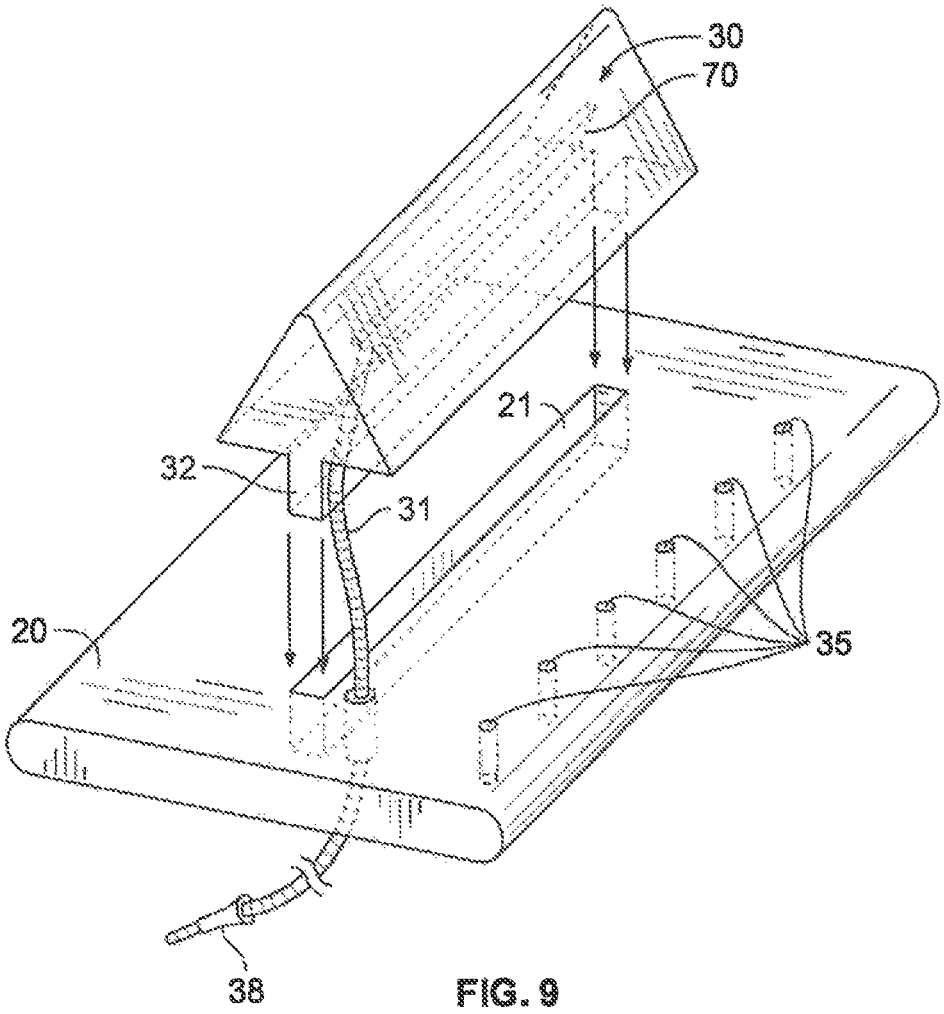
FIG. 9 is another exploded perspective view of the embodiment of the saddle of the present invention, shown in FIGS. 4 and 8, in juxtaposition relative to the bridge plate on the front sound board of the guitar of FIG. 2 with a transducer pick-up 30 internally imbedded within the body of the saddle to form a "saddle up" unit having an electrical wire conductor 31 extending from the transducer pick up 30 in the body of the saddle and an electrical jack 38 which extends from the bridge plate 20 for attachment to a pre-amplifier or amplifier (not shown).

FIG. 8 illustrates the saddle of the present invention having a body 30 in a pyramid configuration as in the embodiment of FIGS. 3-4 and FIG. 4A aligned with its lower section 32 directly above a conventional transducer pick up 70 for insertion into the slot 21 of the bridge plate 20 so that the conventional transducer pick up 70 will lie contiguous to the saddle body 30 when inserted into the slot of the bridge plate 20. FIG. 9 illustrates another embodiment of the present invention with the saddle body 30 incorporating the transducer pick-up 70 within the body 30 of the saddle to from an integrated saddle up unit. Any conventional type of transducer pick-up 70 may be internally imbedded within the body 30 of the saddle having an output electrical wire conductor 31 extending from the transducer pick up 70 and having an electrical outlet jack 38 at its opposite end for insertion into a preamplifier 60 as shown in FIG. 2. The transducer 70 imbedded within the body 30 of the saddle is one unitary, solid piece that permits simple installation as it slides into the slot 21 of the bridge plate 20. The installation of the non-moving saddle increases rigidity and stability of the saddle and thus improves and sustains intonation of the strings.

A transducer pick up 70 may also be internally imbedded within the body 40, 50 and 80 of all or in any one of the saddle embodiments of the present invention to from a single integrated saddle up unit to be inserted into the slot 21 of the bridge plate 20 and/or bridge plate 22 to simultaneously support the guitar strings at a predetermined elevated height and to pick up the vibrations from the guitar strings for conversion into an electrical signal to be supplied to a preamplifier or amplifier as shown in FIG. 2. For example, a transducer pick up 70 may be imbedded in saddle 30 of the first embodiment, saddle 40 of the second embodiment, saddle 50 of the third embodiment and saddle 80 of the fourth embodiment or in all of the saddle embodiments of the present invention. Moreover, each saddle embodiment may have two transducer pick ups imbedded therein in a tandem arrangement so that the transducer pick up in the bottom section of the body of the saddle will primarily pick up vibrations solely from the body of the guitar whereas the second or other transducer pick up located in the upper section of the body of the saddle will primarily pick up vibrations solely from the guitar strings. The transducer 70 imbedded within the body 40, like body 30, is one unitary piece that permits simple installation as it slides into the slot 21 of the bridge plate 20.

Each preamplifier 60 and 62 may be connected externally through ports 63 and 64 to a conventional "Y" connection 66 or alternatively each preamplifier 60 and 62 may be connected to a separate amplifier (not shown) for separately controlling sound from each preamplifier particularly when the saddle includes two transducer pick ups imbedded therein in a tandem arrangement.

What is claimed is:

1. A saddle for a stringed musical instrument which includes a bridge plate attached to a sound board corresponding to an anatomical surface of the musical instrument with a slot in the bridge plate having a geometrical shape adapted to receive the saddle, said saddle comprising a body having at least one member with a first and second section in which the first section, in cross section has opposite ends, and a geometry conforming to the geometry of the slot in the bridge plate and a width approximately equal in dimension to the width of the slot in the bridge so that the opposite ends of the first section tightly fit into the slot of the bridge when the first section is inserted therein and with the second section having a width substantially wider than the width of the first section for substantially increasing the resistance of the saddle to bending forces from tension in the strings of the musical instrument, the second section having sides being flush with the top of the bridge plate to prevent movement of the saddle, wherein said saddle maintains intonation of the stringed instrument and eliminates bending of the stringed instrument.

2. The saddle for a stringed musical instrument as defined in claim 1 with the sides of the second section extending laterally from each opposite end of the first section to form, in combination, a "T" fitting in cross section, wherein bottom surfaces of each lateral side are flush with the top of the bridge plate.

3. The saddle for a stringed musical instrument as defined in claim 2 wherein the lateral sides of the second section extend outwardly from the opposite ends of the first section a distance of at least about 1/16th of an inch from each opposite end of the first section.

4. The saddle for a stringed musical instrument as defined in claim 2, wherein the lateral sides of the second section extend outwardly a distance of at least about 1/8th of an inch from the opposite ends of the first section.

5. The saddle for a stringed musical instrument as defined in claim 2 wherein the geometry of the first section is rectangular when the geometry of the slot in the bridge is rectangular and lies in parallel with the slot in the bridge when inserted therein.

6. The saddle for a stringed musical instrument as defined in claim 5 wherein the second section extends a predetermined distance in height above the first section corresponding to the desired elevation of the strings of the musical instrument above the bridge plate upon in which the saddle is mounted and wherein the saddle corrects elevation of guitar strings and maintains correct intonation.

7. The saddle for a stringed musical instrument as defined in claim 6 wherein the second section comprises a shape which, in cross section, has a geometry selected from the group consisting of a triangular geometry, a curvilinear geometry including a semi-circle or a circular segment corresponding to a sector of a circle, or has a rectangular geometry.

8. The saddle for a stringed musical instrument as defined in claim 1, wherein at least one transducer pick up is imbedded within the body of the saddle to form a single integrated saddle up unit for simultaneously supporting the strings of the musical instrument and for converting vibrations from the strings in the musical instrument into an electrical signal for transmission to a preamplifier or amplifier.

9. The saddle for a stringed musical instrument as defined in claim 7 wherein the transducer pick up is imbedded within the second section of the saddle body to form a single integrated saddle up unit for simultaneously supporting the strings of the musical instrument and for converting vibrations from the strings in the musical instrument into an electrical signal for transmission to a preamplifier or amplifier.

10. The saddle for a stringed musical instrument as defined in claim 9 wherein the transducer pick up is imbedded within both the first and second sections of the saddle body for transmitting electrical signals to separate preamplifiers.

11. The saddle for a stringed musical instrument as defined in claim 2 wherein the body of the saddle comprises at least two members with at least a first member comprising a first and second section in which the first section, in cross section, has opposite ends and a geometry conforming to the geometry of the slot in the bridge plate and a width approximately equal in dimension to the width of the slot in the bridge so that the opposite ends of the first section tightly fit into the slot of the bridge when the first section is inserted therein and with the second section extending from the first section and having a width substantially wider than the width of the first section to form, in combination with the first section, a "T" fitting in cross section, such that the saddle possesses a substantially high strength and resistance to bending forces from tension in the strings of the musical instrument.

12. The saddle for a stringed musical instrument as defined in claim 11 wherein the second section has two sides which extend outwardly from the opposite ends of the first section a distance of at least about 1/16th of an inch from each opposite end of the first section.

13. The saddle for a stringed musical instrument as defined in claim 11 wherein each member in the body of the saddle is arranged in tandem with the saddle further comprising means for manually removably connecting and disconnecting the members from one another.

14. The saddle for a stringed musical instrument as defined in claim 13 wherein said means for removably connecting and disconnecting the members from one another comprises a plurality of male projections extending from one member with the plurality of projections being spaced apart from one another and a corresponding plurality of female openings in the other member in alignment with the plurality of male projections.

15. The saddle for a stringed musical instrument as defined in claim 11 wherein said saddle body includes a second member comprising a plurality of notches corresponding to the number of strings in the musical instrument for separately engaging each of the strings with each notch separated a predetermined distance apart from one another along the length of the second member in a direction parallel to the slot in the bridge into which the first saddle member is inserted.

16. The saddle for a stringed musical instrument as defined in claim 15 wherein the cross sectional geometry of each notch is selected from the group consisting of a triangular geometry, a curvilinear geometry or a rectangular geometry.

17. The saddle for a stringed musical instrument as defined in claim 1 wherein the body of the saddle comprises at least two members with at least a first member comprising a first and second section in which the first section, in cross section, has opposite ends and a geometry conforming to the geometry of the slot in the bridge plate and a width approximately equal in dimension to the width of the slot in the bridge so that the opposite ends of the first section tightly fit into the slot of the bridge when the first section is inserted therein and with the second section extending from the first section and having a width substantially wider than the width of the first section and a second member comprising a plurality of notches corresponding to the number of strings in the musical instrument for separately engaging each of the strings with each notch separated a predetermined distance apart from one another along the length of the second member in a direction parallel to the slot in the bridge into which the first saddle member is inserted and with at least one of the two members comprising an internally embedded transducer pick up so that the saddle forms a saddle up unit for simultaneously supporting the strings of the musical instrument and for converting vibrations from the strings in the musical instrument into an electrical signal for transmission to a preamplifier or amplifier.

18. A saddle for a stringed musical instrument which includes a bridge plate attached to a sound board corresponding to an anatomical surface of the musical instrument with a slot in the bridge plate having a geometrical shape adapted to receive the saddle, said saddle comprising:

a body having at least one member with a first section and a second section in which the first section, in cross section has opposite ends, and a geometry conforming to the geometry of the slot in the bridge plate and a width approximately equal in dimension to the width of the slot in the bridge so that the opposite ends of the first section tightly fit into the slot of the bridge when the first section is inserted therein and with the second section having a width substantially wider than the width of the first section for substantially increasing the resistance of the saddle to bending forces from tension in the strings of the musical instrument, the second section having sides being flush with the top of the bridge plate, wherein the first section and the second section form a right-side up "T" shape, wherein at least one transducer pick up is imbedded and entirely enclosed within the body of the saddle to form a single integrated saddle up unit for simultaneously supporting the strings of the musical instrument and for converting vibrations from the strings in the musical instrument into an electrical signal for transmission to a preamplifier or amplifier, wherein an electrical wire conductor extends from the transducer pick up for transmission of the electrical signal to the preamplifier or amplifier, wherein the saddle maintains intonation of the stringed instrument and eliminates bending of the stringed instrument.

* * * * *